United States Patent [19]

Streich et al.

[11] Patent Number: 4,834,184

[45] Date of Patent: May 30, 1989

[54] DRILLABLE, TESTING, TREAT, SQUEEZE PACKER

[75] Inventors: Steven G. Streich; Donald F. Hushbeck, both of Duncan, Okla.

[73] Assignee: Halliburton Company, Duncan, Okla.

[21] Appl. No.: 247,788

[22] Filed: Sep. 22, 1988

[51] Int. Cl.[4] ..... E21B 33/129

[52] U.S. Cl. ..... 166/376; 166/182; 166/192; 166/387

[58] Field of Search ..... 166/135, 179, 181, 182, 166/192, 196, 376, 387

[56] References Cited

U.S. PATENT DOCUMENTS 3,910,348 10/1975 Pitts ..... 166/135
4,688,641 8/1987 Knieriemen ..... 166/376
4,708,202 11/1987 Sukup et al. ..... 166/376
4,784,226 11/1988 Wyatt ..... 166/387

OTHER PUBLICATIONS

Halliburton Service Sales and Services Catalog No. 43, p. 2561.
Otis General Sales Catalog, pp. 50–63.

*Primary Examiner*—Jerome W. Massie, IV
*Assistant Examiner*—Terry Lee Melius
*Attorney, Agent, or Firm*—James R. Duzan

[57] ABSTRACT

An easily drillable production packer for use in testing, treating and squeeze cementing operations in wells which may be easily converted by securing an appropriate baffle, profile, valve assembly or plug assembly to the lower end of the mandrel thereof.

6 Claims, 3 Drawing Sheets

DRILLABLE, TESTING, TREAT, SQUEEZE PACKER

BACKGROUND OF THE INVENTION

This invention relates to a easily drillable packer for use in testing, treating and squeeze cementing operations in wells.

Production type packers are well known for use in not only producing a well but, also, for use in the testing and the treating of a well. Due to service requirements production packers are typically made of materials to resist erosion and corrision, such as steel, which only allows them to be milled for removal from the well. Typically, production packers may be set in wells by the use of wireline explosive setting tools releasably secured to the packer. Alternately, production packers may also be set by using hydraulically operable or mechanical rotation types of setting tools used in conjunction with tubing.

Production packers also typically may be adapted to be used as bridge plugs, testing tools, and tubing anchors to facilitate various operations to be performed in the Well.

Once such production packer in the prior art is the Otis Perma-Drill® production packer as sold by the Otis Engineering Corporation and described on pages 50 through 63 of the General Sales Catalog.

However, prior art production packers either are not drillable with conventional drilling equipment and using conventional drilling practices as they are usually constructed of steel and are not constructed of cast iron, brass, aluminum alloy, and elastomeric material or may not be easily converted into various types of bridge plugs, testing tools or cementing tools.

Other types of permanent packers in the prior art, which are not production packers, are constructed of easily drillable materials such as cast iron, brass, and elastomeric material. However such permanent packers are not easily converted into use as testing and treating packers. Also, such permanent packers have limited flow areas therethrough, in contrast to the large flow areas of production packers, which prohibit their use as a production packer and prohibit the passage of casing type perforating guns and through tubing tools from being conveyed therethrough. In general, these types of permanent packers may be set using wireline explosive setting tools or using hydraulically operable or mechanical rotation types of setting tools used in conjunction with tubing.

Once such permanent packer in the prior art is the EZ Drill® packer as sold by Halliburton Services Division of Halliburton Company and described on pages 2561 of the Number 43 Sales and Service Catalog of Halliburton Services.

BRIEF STATEMENT OF THE INVENTION

The present invention is directed to a retrievable, easily drillable packer for use in testing, treating and squeeze cementing operations in wells.

The packer of the present invention is fabricated from cast iron, brass, and elastomeric material for easy drilling or milling for removal from the well. The packer of the present invention may be easily converted for use in testing, treating and squeeze cementing operations in wells by securing an appropriate baffle, profile, valve assembly or plug assembly to the lower end of the mandrel thereof.

Also, the packer of the present invention has a large bore therethrough to allow the conveying of casing type production guns and through tubing tools therethrough to be used in the well bore below the packer.

The present invention will be more fully understood when the foregoing drawings are taken in conjunction with a detailed description of the invention.

DESCRIPTION OF THE INVENTION

Figure 1:
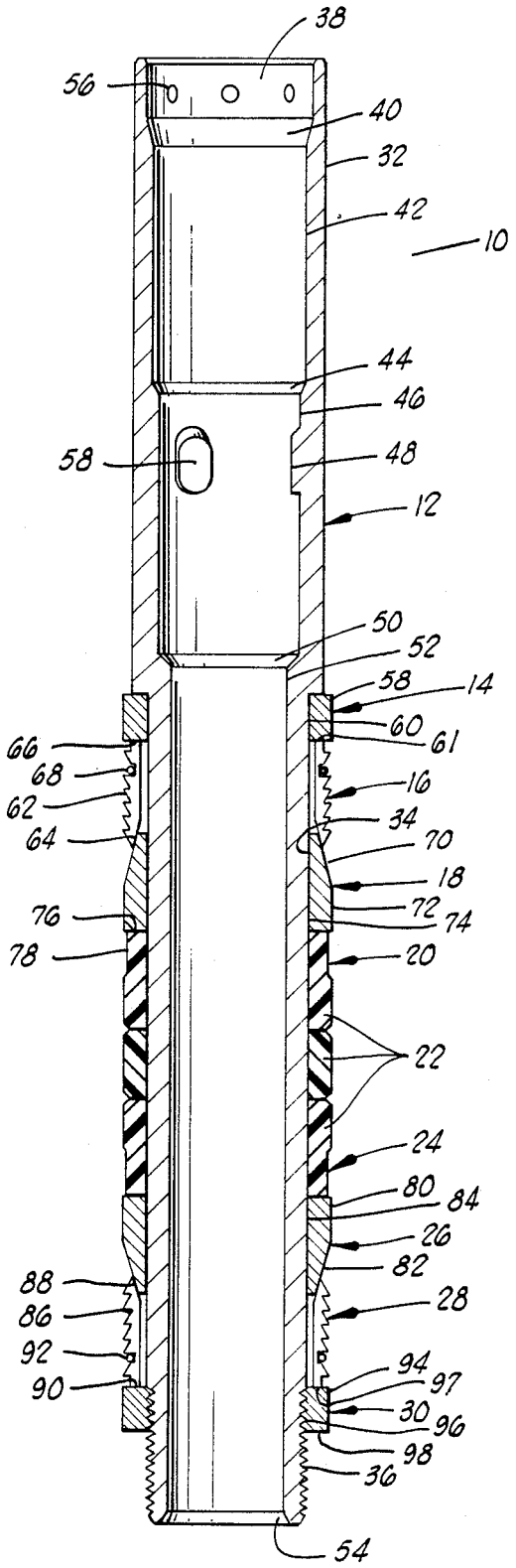
FIG. 1 is a cross-sectional view of the packer of the present invention without any accessories secured to the lower end thereof.

Referring to FIG. 1, the packer 10 of the present invention is shown.

The packer 10 comprises a mandrel 12, upper slip retainer 14, upper slips 16, upper slip wedge 18, upper packer element back-up shoe 20, packer element 22, lower packer element back-up shoe 24, lower slip wedge 26, lower slips 28 and lower slip retainer 30.

The mandrel 12 comprises an elongated cylindrical annular member made of cast iron having, on the exterior thereof, first cylindrical surface 32, second cylindrical surface 34 and threaded surface 6 and, on the interior thereof, first bore 38 having, in turn, a plurality of apertures 56 therein communicating with the exterior of the packer 10, frusto-conical annular surface 40, second bore 42, second frusto-conical annular surface 44, third bore 46 having, in turn, a plurality of lugs 48 extending thereinto and a plurality of apertures 58 therein communicating with the exterior of the packer 10, third frusto-conical annular surface 50, fourth bore 52 and fourth frusto-conical annular surface 54. The fourth bore 52, the smallest diameter bore in the mandrel 12 is formed having a diameter sufficiently large to ensure that casing type perforating guns and through tubing tools may easily pass through the mandrel 12 to be used in the well bore located below the packer 10.

The upper slip retainer 14 comprises an annular cylindrical member made of cast iron having an outer cylindrical surface 58, inner bore 60 which slidingly engages second cylindrical surface 34 of mandrel 12 and annular end surface 61 which abuts the end surface of shaped end portion 66 of each slip 16. The upper slip retainer 14 is initially retained in position with respect to the mandrel 12 by a plurality of shear pins (not shown) having a portion engaging the mandrel 12 and upper slip retainer 14.

Each upper slip 16 comprises a carburized iron elongated member having teeth 62 of the exterior thereof, frusto-conical annular surface portion 64 on the interior thereof and shaped end 66 which has the end surface thereof abutting annular end surface 61 of upper slip retainer 14. When the plurality of slips 16 are assembled each having the shaped end 66 abutting the upper slip retainer 14, the slips 16 are releasably held on the mandrel 12 in a first position by a frangible slip retainer band 68.

The upper slip wedge 18 comprises an annular cylindrical member constructed of cast iron having, on the exterior thereof, frusto-conical annular surface 70 which slidingly engages frusto-conical annular surface portion 64 of each slip 16 and cylindrical surface 72 and, on the interior thereof, bore 74 which slidably engages second cylindrical surface 34 of mandrel 12. The upper slip wedge 18 is initially retained in a first position with respect to the mandrel 12 by a plurality of shear pins (not shown) having a portion engaging the wedge 18 and mandrel 12.

The upper packer element back-up shoe 20 comprises an annular cylindrical member made of brass having a portion 76 abutting a packer element 22 and a portion 78 overlying a portion of a packer element 22. When the packer 10 is set, the portion 78 if the upper packer element back-up shoe 20 expands to support the packer element 22.

The packer elements 22 each comprise an annular cylindrical elastomeric member which slidably engages second cylindrical surface 34 of mandrel 12.

The lower packer element back-up shoe 24 is the same in construction and operation as that of the upper packer element back-up shoe 20.

The lower slip wedge 26 is an annular cylindrical member constructed of cast iron having, on the exterior thereof, cylindrical surface 80 and frusto-conical annular surface 82 and, on the interior thereof, bore 84 which slidingly engages second cylindrical surface 34 of the mandrel 12. The lower slip wedge 26 is initially retained in position on the mandrel 12 by a plurality of shear pins (not shown) having a portion thereof engaging the mandrel and the lower slip wedge.

The lower slips 28 are the same in construction as the upper slips 16 having teeth 86, frusto-conical surface 88, shaped end 90 and frangible slip retainer band 92.

The lower slip retainer 30 comprises an annular cylindrical member made of cast iron having an outer cylindrical surface 94, threaded bore 96 which threadably engages threaded portion 36 of mandrel 12 and an annular end surface 97 which abuts the end surface of shaped end portion 90 of lower slips 28 therein. The lower slip retainer may be, if so desired, further retained in position with respect to the mandrel 12 by a plurality of shear pins (not shown) having a portion engage the mandrel 12 and lower slip retainer 30.

Figure 2:
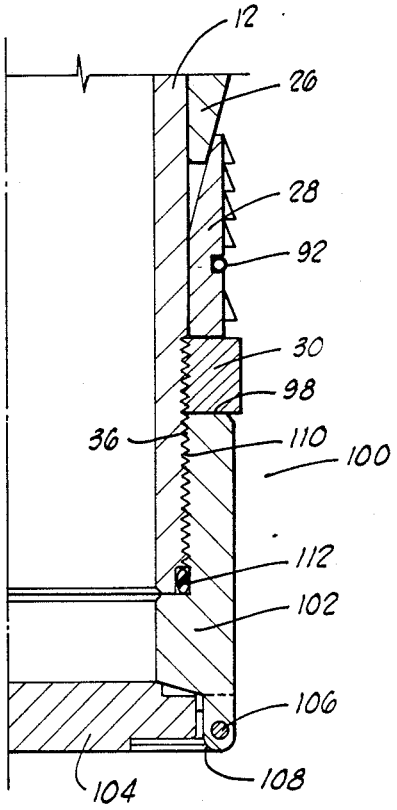
FIG. 2 is a partial cross-sectional view of a portion of the packer of the present invention with a flapper type valve assembly secured to the lower end of the packer.

Referring to FIG. 2, a portion of the packer 10 is shown having a flapper valve assembly 100 secured to the mandrel 12 of the production packer 10 of the present invention. The flapper valve assembly 100 comprises valve housing 102, flapper valve 104, pin 106 and valve spring 108. The valve assembly 100 is secured to the mandrel 12 by threaded bore 110 of valve housing threadedly engaging threaded surface 36 of the mandrel 12. An annular elastomeric seal member 112 provides the fluid seal between the valve housing 102 and mandrel 12.

Figure 3:
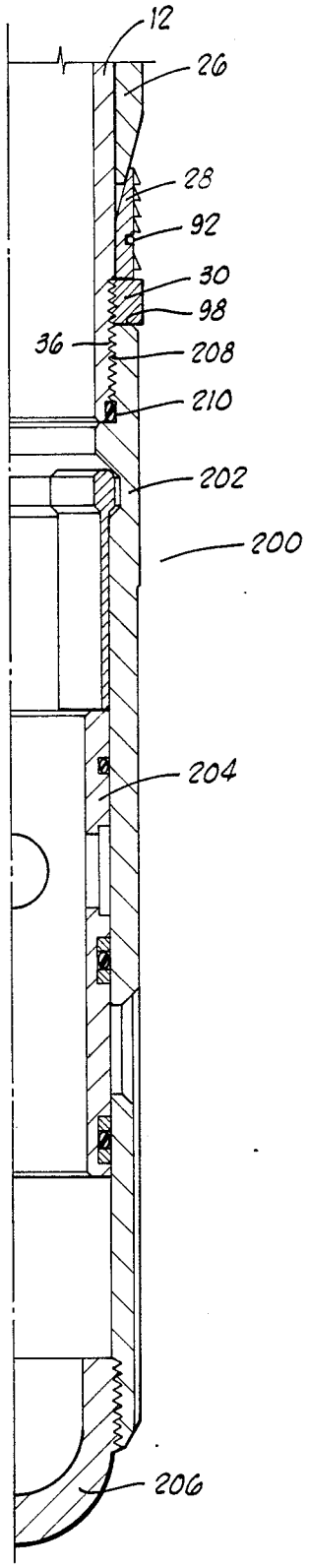
FIG. 3 is a partial cross-sectional view of a portion of the packer of the present invention with a sliding sleeve type valve assembly secured to the lower end of the packer.

Referring to FIG. 3, a sliding sleeve valve assembly 200 is shown secured to the mandrel 12 of the packer 10 of the present invention. The sliding sleeve valve assembly 200 comprises housing 202, sliding valve sleeve 204, and valve cap 206. The sliding sleeve valve assembly 200 is secured to the mandrel 12 by the threaded bore 208 of valve housing 202 threadedly engaging threaded surface 36 of the mandrel 12. An annular elastomeric seal member 210 provides the fluid seal between the valve housing 202 and mandrel 12.

Figure 4:
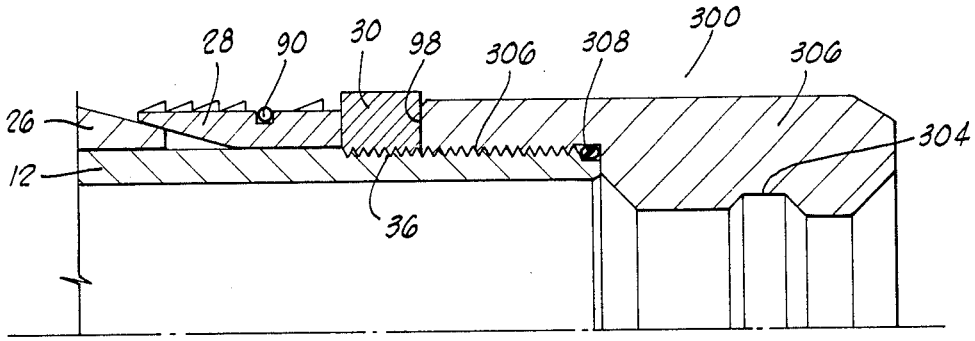
FIG. 4 is a partial cross-sectional view of a portion of the packer of the present invention with a profile secured to the lower end of the packer.

Referring to FIG. 4, a profile 300 is shown secured to the mandrel 12 of the packer 10 of the present invention. The profile 300 comprises an annular cylindrical member 302 having a profile 304 on the interior thereof and threaded bore 306. The profile 300 is secured to the mandrel 12 by threaded bore 306 threadedly engaging threaded portion 36 of mandrel 12. An annular elastomeric seal member 308 provided the fluid seal between the mandrel 12 and profile 300.

Figure 5:
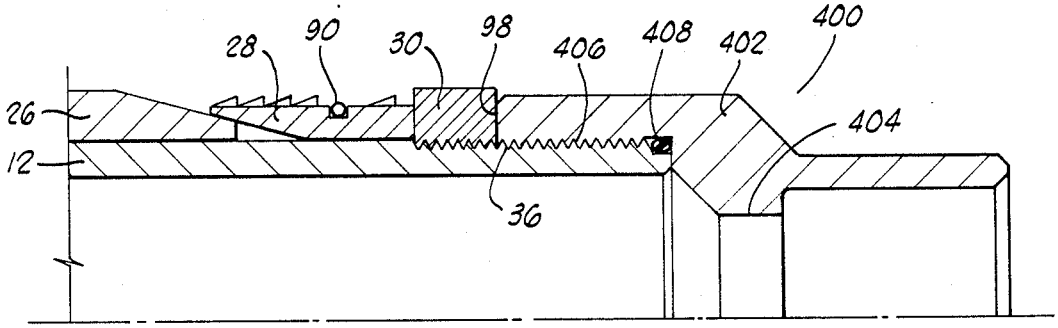
FIG. 5 is a partial cross-sectional view of a portion of the packer of the present invention with a baffle secured to the lower end of the packer.

Referring to FIG. 5, a baffle 400 is shown secured to the mandrel 12 of the packer 10 of the present invention. The baffle 400 comprises an annular cylindrical member 402 having a baffle 404 on the interior thereof and threaded bore 406. The baffle 400 is secured to the mandrel 12 by threaded bore 406 threadedly engaging threaded portion 36 of the mandrel 12. An annular elastomeric seal member 408 provides the fluid seal between the mandrel 12 and baffle 400.

Figure 6:
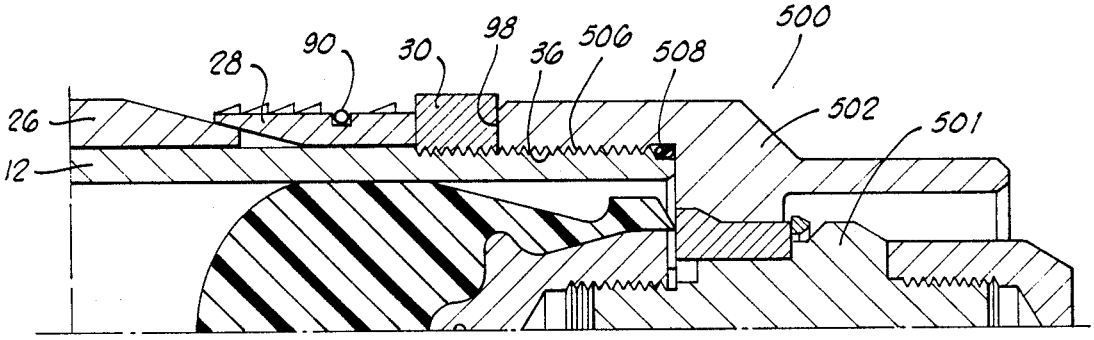
FIG. 6 is a partial cross-sectional view of a portion of the packer of the present invention with a cementing plug assembly secured to the lower end of the packer.

Referring to FIG. 6, a latch down cementing plug assembly 500 is shown secured to the mandrel 12 of the packer 10 of the present invention. The latch down cementing plug assembly 500 comprises annular cylindrical profile 502 and latch down plug 504. The latch down cementing plug assembly 500 is secured to the mandrel 12 by threaded bore 506 of the profile 502 threadedly engaging threaded surface 36 of the mandrel 12. An annular elastomeric seal member 508 provides the fluid seal between the mandrel 12 and latch down plug assembly 500.

Referring to FIG. 2 through FIG. 6, it should be noted that by threadedly securing the valve housing 102 of the flapper valve assembly 100, the housing 202 of the sliding sleeve valve assembly 200, the annular cylindrical member 302 of profile 300, the annular cylindrical member 402 of baffle 400 or the annular cylindrical profile 502 of latch down cementing plug assembly 500 to the threaded surface 36 of the mandrel 12 with the annular end surface of the various housings, cylindrical members, etc. abuttingly engaging the annular end surface 98 of lower slip retainer 30, the lower slip retainer 30 and the various housings, cylindrical members, etc. are threadedly locked onto mandrel 12 to prevent rotation thereon.

OPERATION OF THE INVENTION

Referring to FIG. 1, to set the packer 10 of the present invention a portion of a setting tool (not shown) is inserted into the interior of the packer 10 with the portion of the setting tool engaging the lugs 48.

The setting tool having the packer 10 connected thereto is conveyed into the well to the desired location to set the packer. At this time, the setting tool is actuated to cause a portion of the setting tool to slide over the upper portion of the mandrel 12 to abut the upper slip retainer 14 while relative movement between the mandrel 12 and sleeve abutting the upper slip retainer 14 occurs. The relative movement between the mandrel 12 and upper slip retainer 14 causes the shear pins retaining upper slip retainer 14, upper slip wedge 18 and lower slip wedge 26 to shear as well as frangible slip retainer bands 68 and 92 to break thereby allowing the upper slip wedge 18 and lower slip wedge 26 to compress the packer elements 22 into sealing engagement with the well bore while upper slips 16 and lower slips 28 are cammed into engagement with the well bore. At this time with the packer 10 set in the well, the setting tool is removed from the packer 10 and if desired, from the well in which the packer 10 is set.

When the packer 10 is set in the well, the mandrel 12 is free to float with respect to the upper slip retainer 14, upper slips 16, upper slip wedge 18, packer elements 22, lower slip wedge 26 and lower slips 28 as all the shear pins have been sheared and the shaped ends of the slips no longer engage the upper 14 and lower 30 slip retainers respectively. At this time, any desired well testing, treating or cementing operation may be performed through the packer 10 depending upon the assembly connected to the lower end of mandrel 12.

To remove the packer 10 from the well it may either be drilled from the well using a standard rock bit using conventional drilling practices or it may be milled from the well using an overshot mill to mill the upper slips 16 loose from engagement from the well thereby releasing the packer elements 22 and lower slips 28 from engagement with the well so that the packer 10 may then be removed from the well by a retrieving tool.

It will be appreciated that the packer 10 is easily drilled or milled for removal from the well as it is constructed of cast iron, brass and rubber materials which are easily removed by standard rock bits or mills.

Also, it will be appreciated that the packer 10 may be easily converted to a wide variety of uses by installing the desired baffle, profile, valve assembly or cementing plug assembly on the packer for use.

It will be further appreciated that the packer 10 has a large bore therethrough to facilitate the passage of casing type perforating guns and through tubing tools through the packer 10 for use in the portion of the well bore located below the packer 10.

Having thus described our invention, we claim:

1. A packer for use in a well, said packer being adapted for use as a testing packer, a treating packer and cementing packer and being adapted to be easily retrievable from said well by drilling or milling operations, said packer comprising:

a cast iron mandrel having a retrieving lug on the interior thereof, a bore therethrough having a diameter sufficiently large to allow the passage of casing type perforating guns, through tubing tools and the like therethrough, and a threaded bottom portion;

a cast iron upper slip retainer slidably, releasably retained on a portion of the mandrel in a first position thereon by a plurality of shear pins having a portion thereof engaging the mandrel and the upper slip retainer, the upper slip retainer being formed with an annular end surface thereon;

a plurality of upper slips, each slip of the plurality of upper slips having a portion engaging a recess of the plurality of recesses in the upper slip retainer, the plurality of upper slips being retained in a first position about the mandrel having a portion of each upper slip of the plurality of upper slips engaging the annular end surface of the upper slip retainer by a frangible slip retainer band engaging a portion of each upper slip of the plurality of upper slips;

a cast iron upper slip wedge slidably, releasably retained on the mandrel in a first position thereon by a plurality of shear pins having a portion thereof engaging the mandrel and the upper slip wedge, the upper slip wedge having a portion thereof engaging a portion of the plurality of upper slips adapted to cause the plurality of slips to move radially outwardly upon action of said packer to set the packer in said well;

a brass upper packer element support shoe having a portion thereof abutting a portion of the upper slip wedge;

an elastomeric packer element slidably retained on the mandrel having a first portion thereof abutting a first portion of the upper packer element support shoe and having another portion thereof underlying another portion of the upper brass packer element support shoe;

a brass lower packer element support shoe having a first portion thereof abutting another portion of the elastomeric packer element and having another portion thereof overlying another portion of the elastomeric packer element;

a cast iron lower slip wedge slidably, releasably retained on the mandrel in a first position thereon by a plurality of shear pins having a portion thereof engaging the mandrel and the lower slip wedge, the lower slip wedge having a frusto-conical portion thereon;

a plurality of lower slips, each slip of the plurality of lower slips having an end portion and a portion adapted to slidingly engage the frusto-conical portion of the lower slip wedge to cause the plurality of slips to move radially outwardly upon actuation of said production packer to set the production packer in said well, the plurality of lower slips being retained in a first position about the mandrel by a frangible slip retainer band engaging a portion of each lower slip of the plurality of lower slips; and a cast iron lower slip retainer threadedly, releasably retained on a first portion of the threaded bottom portion of the mandrel, the lower slip retainer being formed with an annular end surface thereon for abutting the end portions of the lower plurality of slips therein to retain the plurality of lower slips in initial engagement with the lower slip retainer.

2. The packer of claim 1 further comprising:

a flapper type valve assembly threadedly secured to a second portion of the threaded bottom portion of the mandrel of said production packer.

3. The packer of claim 1 further comprising:

a sliding sleeve type valve assembly threadedly secured to a second portion of the threaded bottom portion of the mandrel of said packer.

4. The packer of claim 1 further comprising:

a profile threadedly secured to a second portion of the threaded bottom portion of the mandrel of said packer.

5. The packer of claim 1 further comprising:

a baffle threadedly secured to a second portion of the threaded bottom portion of the mandrel of said packer.

6. The packer of claim 1 further comprising:

a latch down type cementing plug assembly threadedly secured to a second portion of the threaded bottom portion of the mandrel of said packer.

* * * * *

UNITED STATES PATENT AND TRADEMARK OFFICE

CERTIFICATE OF CORRECTION

PATENT NO. : 4,834,184

DATED : May 30, 1989

INVENTOR(S) : Steven G. Streich et al

It is certified that error appears in the above-identified patent and that said Letters Patent is hereby corrected as shown below:

In column 2, line 44, delete the numeral [6] and insert therefore —36—.

Signed and Sealed this

Tenth Day of April, 1990

*Attest:*

HARRY F. MANBECK, JR.

*Attesting Officer*

*Commissioner of Patents and Trademarks*